US005894986A

United States Patent [19]

Lederman et al.

[11] Patent Number: 5,894,986

[45] Date of Patent: Apr. 20, 1999

[54] MAILING ENVELOPE INCORPORATING DECORATIVE TRANSPARENCY

[75] Inventors: Fred B. Lederman, San Antonio; June Bush, Carrollton, both of Tex.

[73] Assignee: Focus Direct, Inc., San Antonio, Tex.

[21] Appl. No.: 08/744,410

[22] Filed: Nov. 7, 1996

[51] Int. Cl.[6] ..... B65D 27/04

[52] U.S. Cl. ..... 229/71; 229/303; 283/56; 283/116

[58] Field of Search ..... 229/71, 303, 97.8; 283/56, 116

[56] References Cited

U.S. PATENT DOCUMENTS

| | | | |
|---|---|---|---|
| 897,777 | 9/1908 | Pflueger | 229/71 |
| 1,545,246 | 7/1925 | Freeman | 229/71 |
| 1,810,649 | 6/1931 | Elliott | 229/71 |
| 2,035,218 | 3/1936 | Bloom | 229/71 |
| 2,256,399 | 9/1941 | MacHarg . | |
| 2,681,175 | 6/1954 | David . | |
| 3,195,802 | 7/1965 | Jacobs | 229/71 |
| 3,512,702 | 5/1970 | Pritchard, Jr. | 229/71 |
| 3,692,233 | 9/1972 | Carter, Jr. | 229/71 |
| 4,313,557 | 2/1982 | Foffel | 283/56 |
| 4,597,591 | 7/1986 | Gendron et al. | 229/71 |
| 4,640,030 | 2/1987 | Wood et al. . | |
| 4,993,624 | 2/1991 | Schlich | 229/303 |
| 5,251,810 | 10/1993 | Kim | 229/303 |
| 5,294,042 | 3/1994 | Giordano | 229/71 |

*Primary Examiner*—Stephen P. Garbe
*Attorney, Agent, or Firm*—Akin, Gump, Strauss, Hauer & Feld, L.L.P.

[57] ABSTRACT

An inexpensive mailing envelope with a window opening to which a decorative image-bearing sheet member is attached. The image-bearing sheet member may be transparent or semi-opaque, partially revealing the contents of the said envelope. The inclusion of a decorative image visible from the outside of the envelope induces mailing recipients to open the envelope and examine the contents inserted therein. The window opening may be placed on the rear panel of the envelope, opposite the panel displaying address information. The image-bearing sheet material may be detachable and may be promoted as a gift.

10 Claims, 5 Drawing Sheets

MAILING ENVELOPE INCORPORATING DECORATIVE TRANSPARENCY

BACKGROUND OF THE INVENTION

The present invention relates generally to mailing envelopes, and more particularly to mailing envelopes having one or more windows and having image-bearing sheet members (such as photographic slides or transparencies) mounted in one or more of those windows.

Typically, bulk mail advertisers utilize decorative envelopes in order to capture the addressees' attention and engender their interest in examining the contents of the envelope. Often disinterested addressees simply discard the mailings without even opening them. The need to attract consumer curiosity has led individuals to seek other creative methods to make their envelopes more inviting. One marketing technique could be derived from U.S. Pat. No. 2,256,399, which sets forth a picture-carrying post card. However, the card does not include a conventional mailing envelope pocket permitting the enclosure of articles. Moreover, the picture-carrying slide requires the post card to incorporate a frame in which to carry a lantern slide, which increases the cost of the post card's manufacture. Also, a combination envelope and cardboard picture frame is set forth in U.S. Pat. No. 4,640,030, but the picture is enclosed within the interior of the envelope, hidden from view. Furthermore, the combination envelope and cardboard picture frame is not adapted to permit the recipient to see, while the envelope remains sealed, both the picture through an envelope window and a portion of the contents of the envelope through the picture. Other envelope marketing techniques incorporate illustrations on the paper surface of the envelope.

Bulk mailing envelopes commonly incorporate windows located at the portion of the envelope where the mailing address is to be displayed. This obviates the need of printing the recipients address on the envelope itself, since the address will instead be printed on materials inserted inside the envelope and situated to display the address in the window. Some mailing envelopes attach a clear or colored transparent plastic to the address display window. Other mailing envelopes incorporate windows covered with clear or colored transparent plastic to reveal other contents inside the envelope, for example, a sweepstakes greeting or number.

While illustrations and display windows are sometimes used to decorate a mailing envelope, the technique of mounting a detachable image-bearing sheet member on an envelope window has not been used.

SUMMARY OF THE INVENTION

The object of the present invention is to provide an inexpensive mailing envelope with decorative features for inducing the recipient to examine the contents thereof. A more particular object of the present invention is to provide a mailing envelope with a decorative feature which allows the recipient to see through to the contents of the envelope. A further object of this invention is to provide a mailing envelope with a decorative image-bearing sheet member that may be detached from said envelope by opening said envelope and removing adhesive strips which attach said sheet member to said envelope.

Accordingly, the present invention provides an envelope including an address-bearing panel opposite of a rear panel. The present invention further provides at least one of said panels including a window on which a decorative slide is mounted for display. The present invention further provides that said panels of said envelope be folded and/or connected so as to define an enclosure of which three sides are closed and a fourth side is open for the insertion of mailing materials.

In the preferred embodiment, the panel on which said image-bearing sheet member is mounted defines a back of said envelope, the front of said envelope defined as a panel bearing conventional postal information. More particularly, the present invention provides an elongated strip of sheet material having a display panel, an address panel folded towards said display panel, two side flaps also folded towards said display panel and adhesively connected to said address panel, and a seal flap for sealing said enclosure. Also, the present invention provides that said image-bearing sheet member be easily detachable from the envelope so as to double as a gift accessible only by opening the envelope.

BRIEF DESCRIPTION OF THE DRAWINGS

The accompanying drawings provide a reference from which a better understanding of the present invention may be drawn wherein the figures depict various views and embodiments of the present invention and wherein like reference numerals identify like elements in the several figures, and in which.

DETAILED DESCRIPTION OF THE PREFERRED EMBODIMENT

Figure 1:
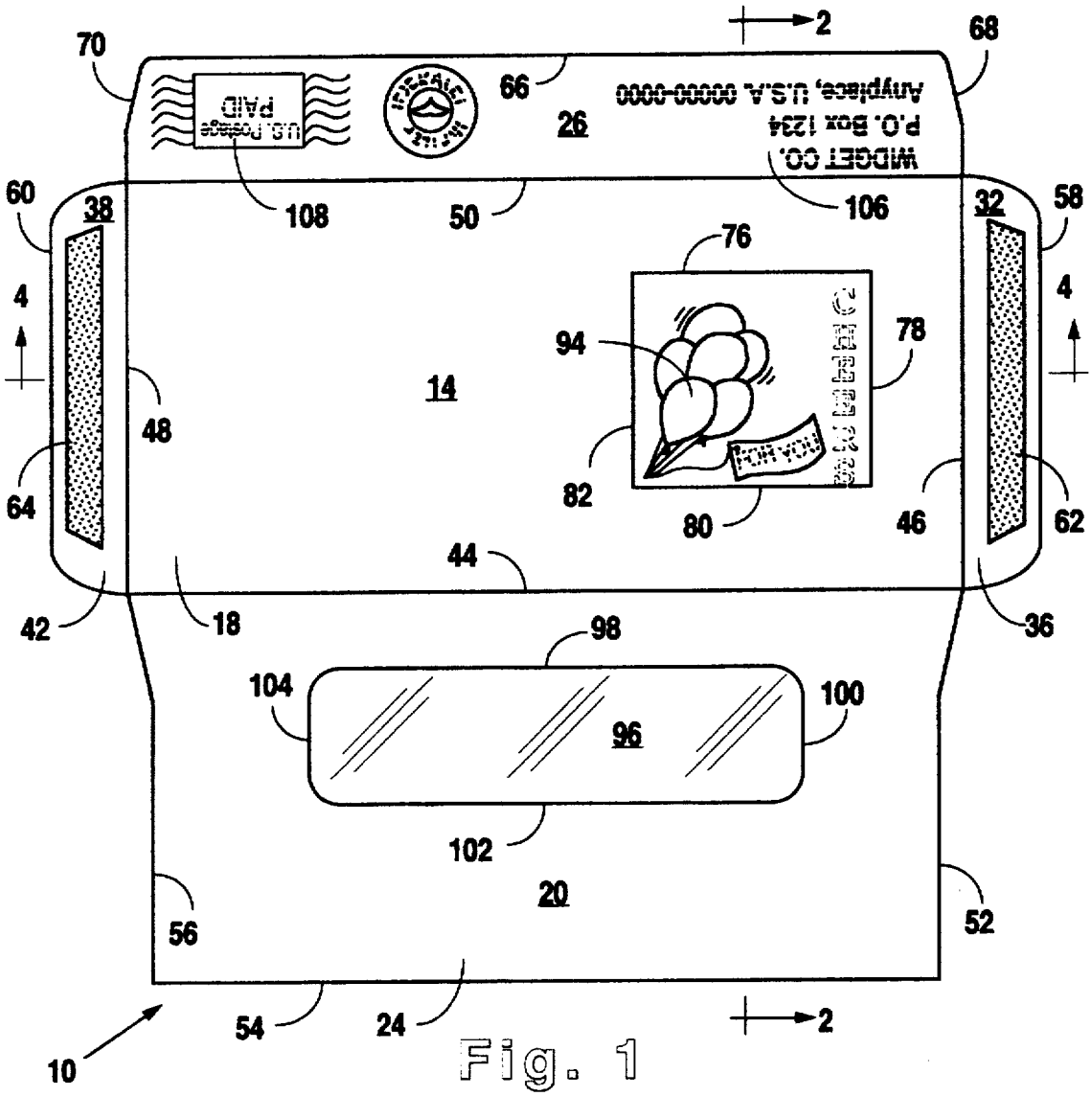
FIG. 1 is a plan view of the exterior of a mailing envelope according to the present invention, including decorative image.
Figure 2:
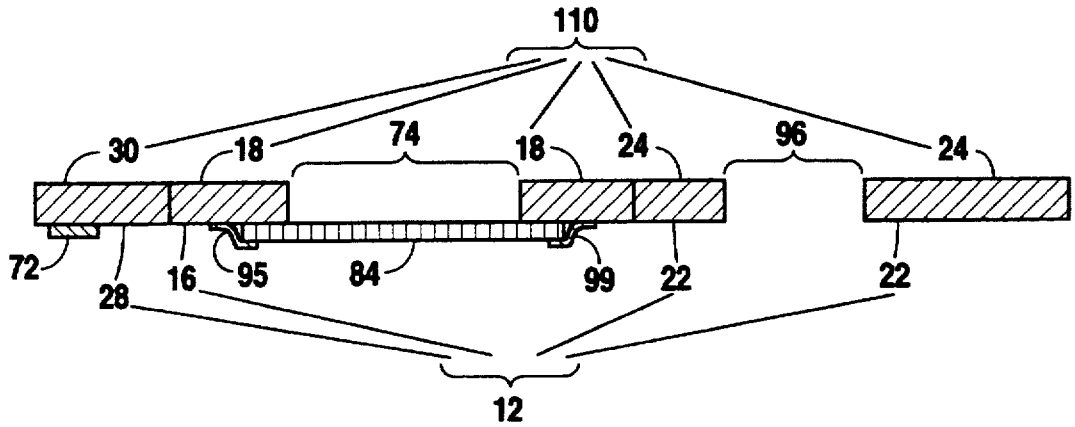
FIG. 2 is an enlarged section on line 2—2 of FIG. 1, with parts shown in exaggerated thickness.
Figure 3:
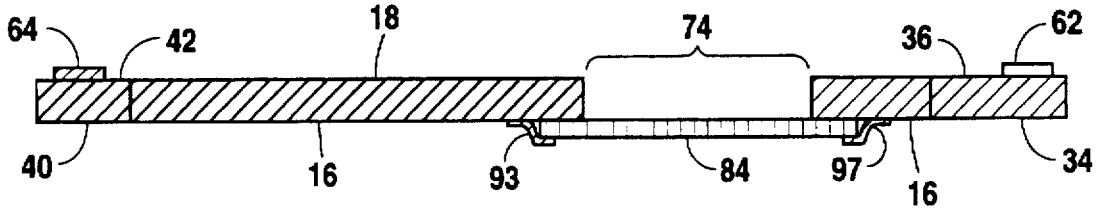
FIG. 3 is an enlarged section on line 4—4 of FIG. 1, with parts shown in exaggerated thickness.
Figure 4:
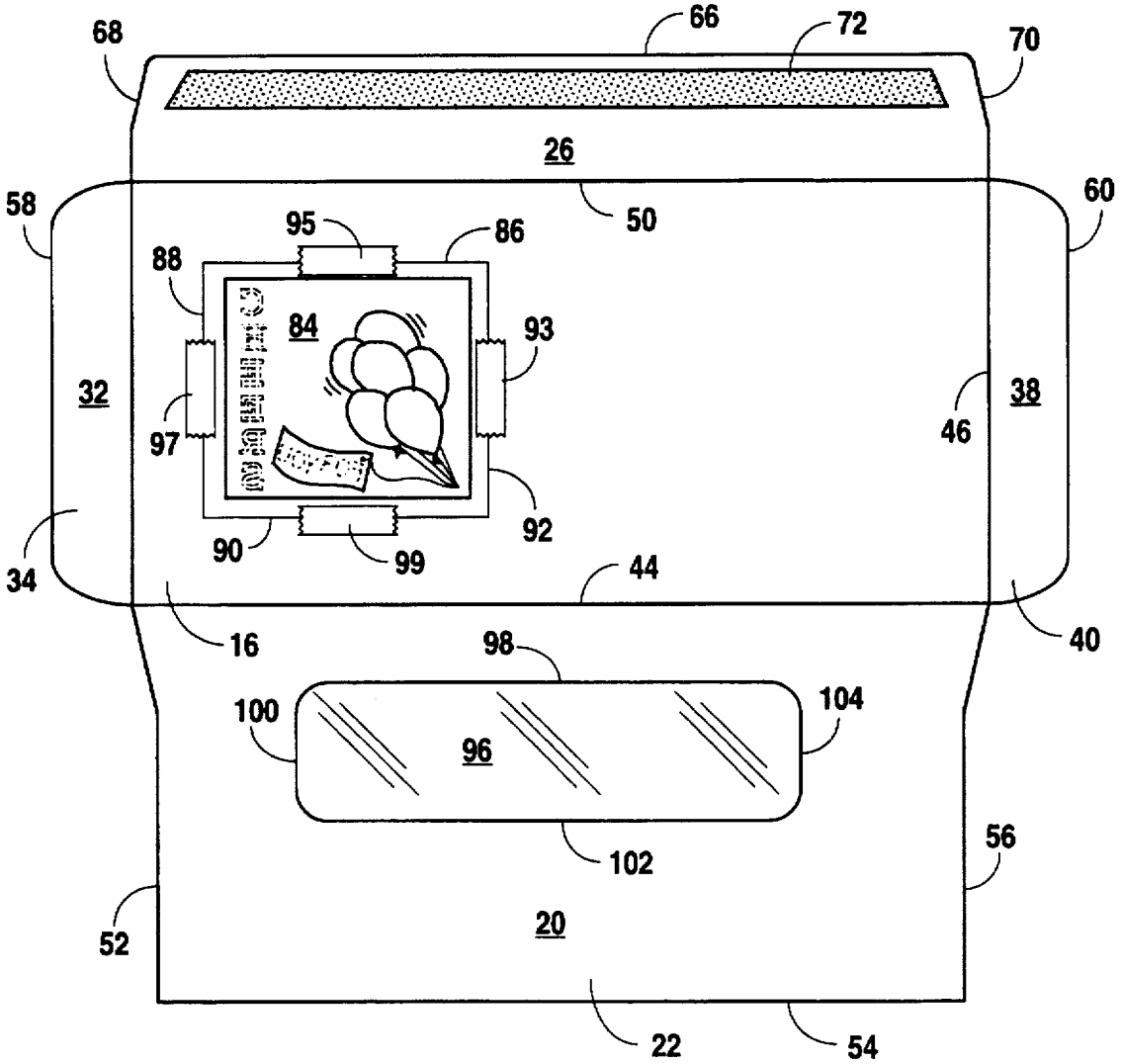
FIG. 4 is a plan view of the interior of said mailing envelope of FIG. 1, detailing the attachment of the decorative image-bearing sheet member to said envelope.

FIGS. 1–4 show a plan view of envelope 10 which corresponds to the preferred embodiment of the present invention. FIG. 1 shows exterior surface 110 of envelope 10 and FIG. 4 shows interior surface 12 of same envelope 10. Envelope 10 includes a generally rectangular display panel 14 having interior surface 16 and exterior surface 18 and bounded by fold lines 44, 46, 48 and 60 by which display panel 14 is connected, respectively, to address panel 20, side flaps 32 and 38, and envelope seal flap 26. Display panel 14 includes a generally rectangular display window opening 74 to partially visibly expose the contents of envelope 10 when stuffed and sealed. Display window opening 74 is bounded by sides 76, 78, 80, and 82. A generally rectangular decorative image-bearing sheet member 84 imprinted with image or picture 94 which may be diaphanous or translucent is mounted by means of adhesive strips of tape 93, 95, 97, and 99 on interior surface 16 of display panel 14, completely covering display window opening 74. Sheet member 84 is bounded by sides 86, 88, 90, and 92 which are positioned, respectively, in parallel with sides 76, 78, 80, and 82 of display window opening 74.

Extending downwardly from display panel 14 and contiguous along fold line 44 is a generally rectangular address panel 20 including interior surface 22 and exterior surface 24. Address panel 20 is bounded by fold line 44 and sides 52, 54, and 56 and includes a generally rectangular address window 96 bounded by sides 98, 100, 102, and 104. Address window 96 is positioned on address panel 20 so as to correspond with conventional postal practices.

Side flaps 32 and 38 are generally rounded trapezoids and include, respectively, interior surfaces 34 and 40 and exterior surfaces 36 and 42. Side flap 32 is bounded by fold line 46 and a rounded trapezoidal edge 68. Likewise, side flap 38 is bounded by fold line 48 and rounded trapezoidal edge 60. Exterior surfaces 36 and 42 of side flaps 32 and 38 each include adhesive strips 62 and 64 extending vertically along the length of the said side flaps and are adapted to attach to interior surface 22 of address panel 20 when envelope 10 is assembled.

Extending upwardly from display panel 14 is a generally trapezoidal envelope seal flap 26 including interior surface 28 exterior surface 30 and bounded by fold line 50 and sides 66, 68 and 70. Adhesive strip 72 extends horizontally along the length of envelope seal flap 26 on its interior surface 26 and near its top edge 66 and is adapted to seal envelope 10 after it is assembled and stuffed. A return address 106 and postage 108 may be designated on exterior surface 30 of envelope seal flap 26.

Figure 5:
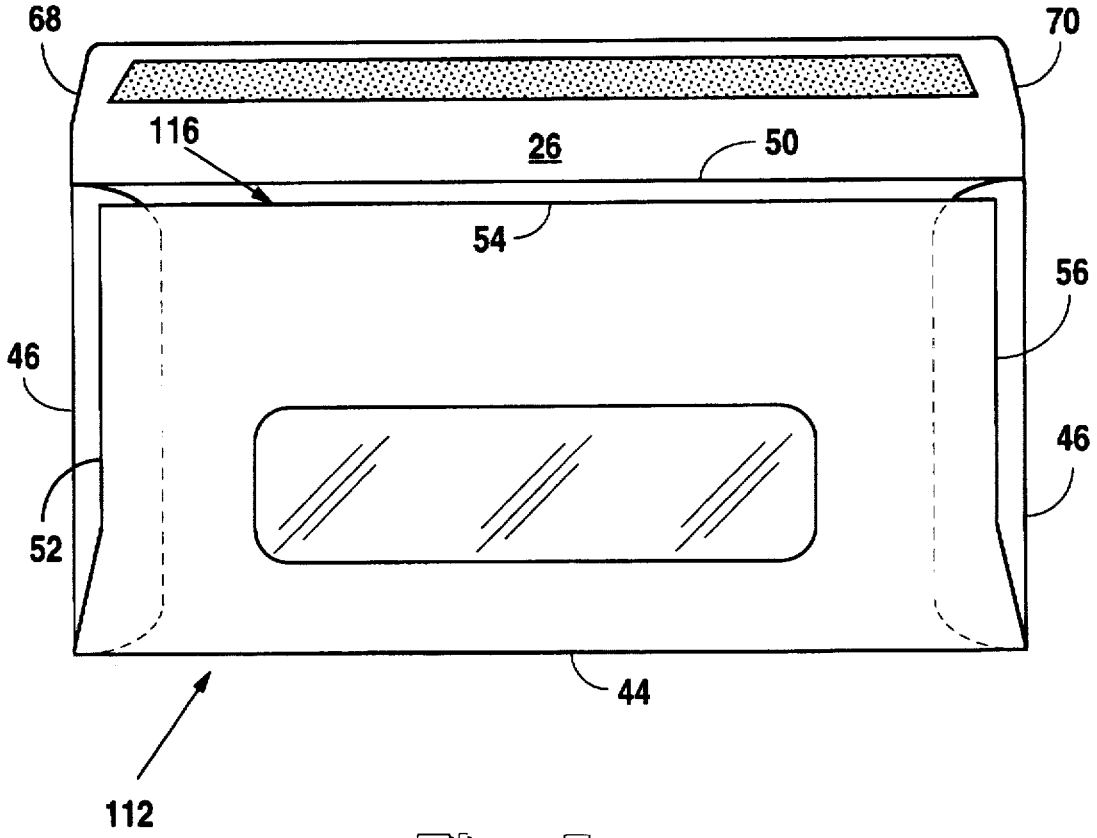
FIG. 5 is a frontal view of the address face of the envelope of FIG. 1 folded but unsealed for mailing.
Figure 6:
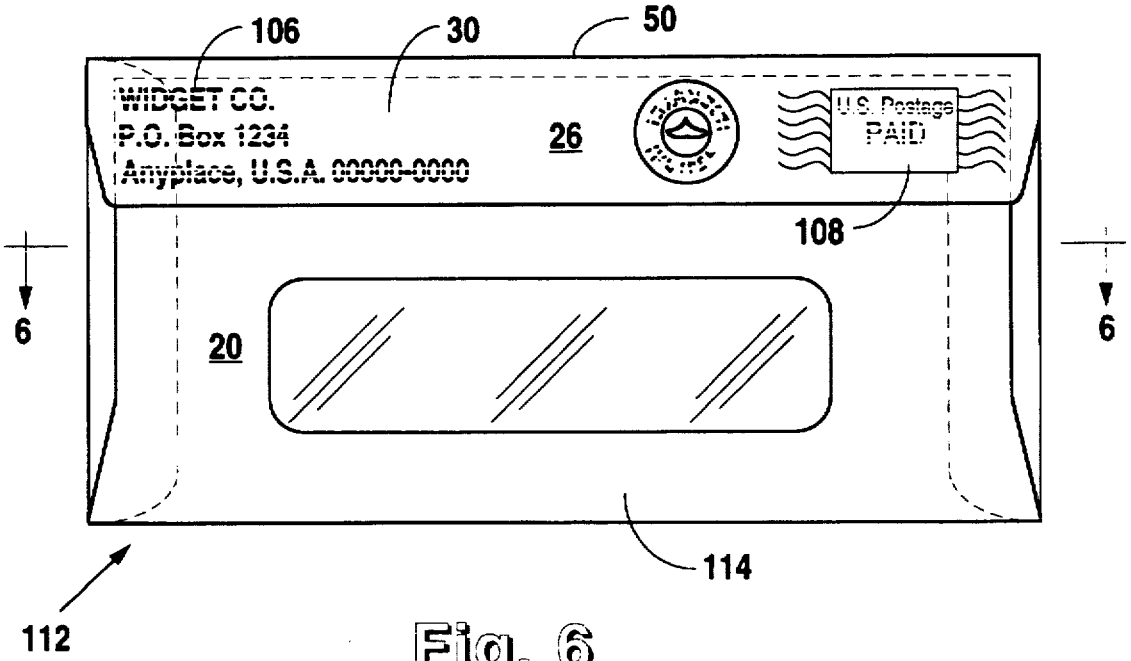
FIG. 6 is a frontal view of the address face of the envelope of FIG. 1 folded and sealed for mailing.
Figure 7:
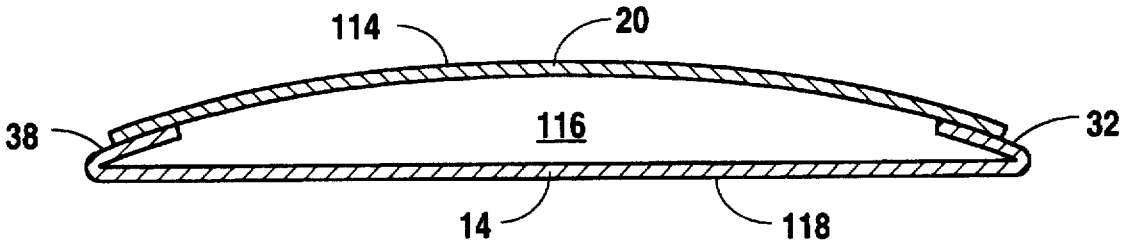
FIG. 7 is an enlarged section on line 6—6 of FIG. 6, with parts shown in exaggerated thickness.

FIGS. 5–8 show front, back, and cross sectional views of assembled envelope 112. Front surface 114 and back surface 118 of envelope 112 are indicated on FIG. 7. FIG. 5 shows front surface 114 of assembled envelope 112, which is formed by taking envelope 10 of FIGS. 1–4, folding side flaps 32 and 38 along fold lines 46 and 48, respectively, toward interior surface 16 of display panel 14 and thereafter folding address panel 20 along fold line 44 toward interior surface 16 of display panel 14 and affixing interior surface 22 of address panel 20 to exterior surfaces 36 and 42 of side flaps 32 and 38 through the adhesive means provided by adhesive strips 62 and 64. Envelope 112 includes pocket 116 bounded by interior surfaces 16, 22, 34, and 40 of display panel 14, address panel 20, and side panels 32 and 38, fold lines 44, 46, and 48, the perimeter of the pocket opening being substantially formed by fold line 50 and display panel edge 54. From a sectional view along line 6—6 of FIG. 6, FIG. 7 shows pocket 116 bounded by display panel 14, address panel 20, and side panels 32 and 38. Mailing materials may preferably be inserted into pocket 116 of envelope 112 before envelope seal flap 26 is folded and sealed.

Figure 8:
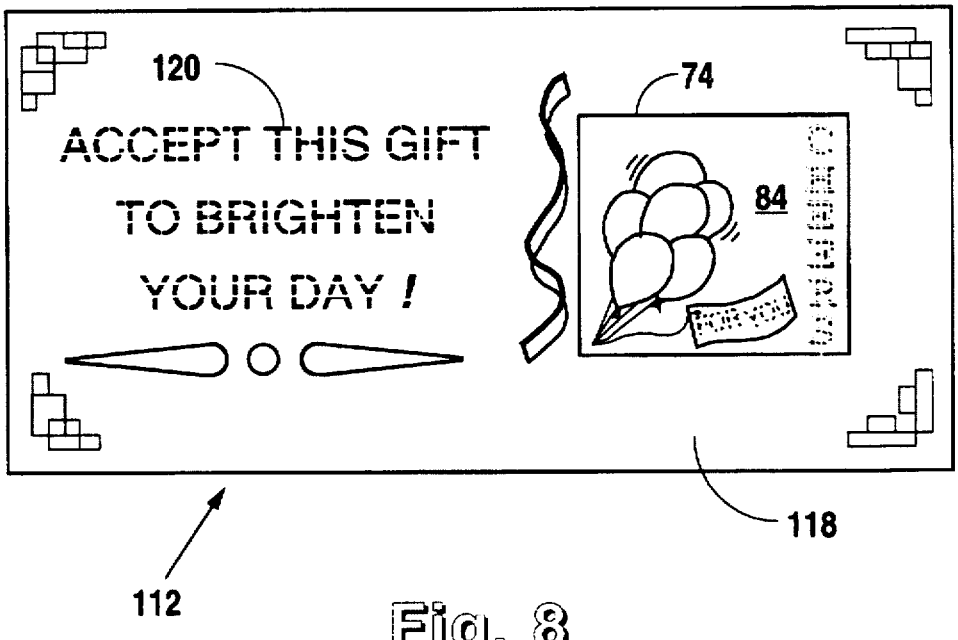
FIG. 8 is a view of the rear panel, including image-bearing sheet member, of the envelope of FIG. 1, folded and sealed for mailing.

FIG. 6 again shows front surface 114 of assembled envelope 112 but with envelope seal flap 26 folded along fold line 50 over exterior surface 24 of address display panel 20. FIG. 8 shows back surface 118 of same envelope 112. Promotional insignia 120 may be displayed on a portion of envelope 112 to the side of display window opening 74 beneath which decorative sheet member 84 is mounted.

Figure 9:
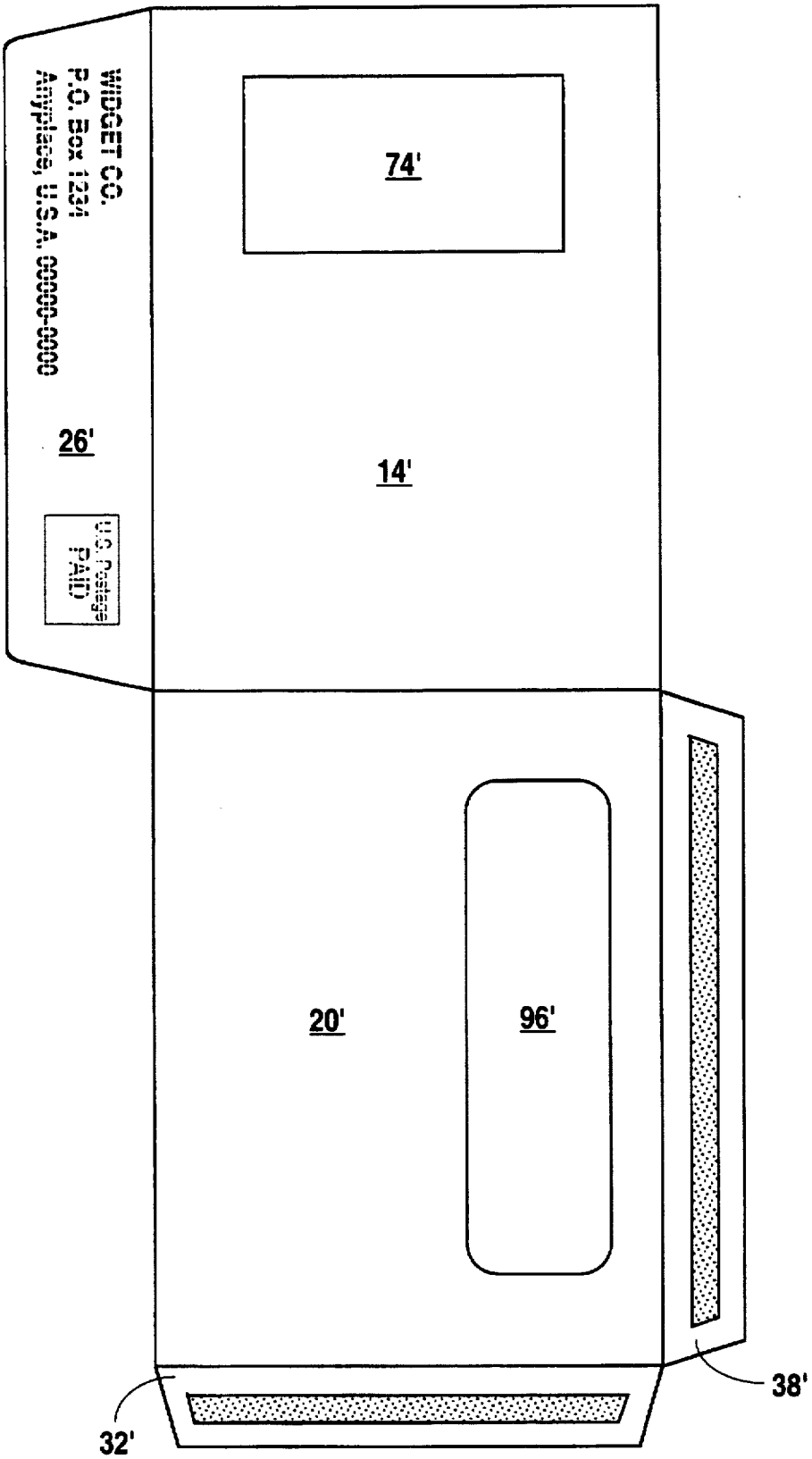
FIG. 9 is an alternative plan view of the exterior of a mailing envelope according to the present invention, including decorative image.

FIG. 9 sets forth an alternative embodiment of an envelope according to the present invention revealing a plan view having a different configuration of address panel 20', display panel 14', and connecting flaps 32' and 38'. Comparable or identical components of FIG. 9 and FIG. 1 use the same reference numbers with a "prime" added. Also shown on the embodiment of FIG. 9 is the envelope seal flap 26', an address window 96', and a display window opening 74'. The figure illustrates one of the many different ways in which an envelope may be constructed while incorporating a decorative image-bearing sheet member.

The image-bearing sheet member is preferably transparent. Alternatively, the sheet member may be translucent or opaque. This not only permits the recipient to see the image borne by the sheet material, but it partially reveals the text or other contents of the envelope.

The image-bearing sheet member is preferably manufactured from polyethylene cellophane, or some other diaphanous and flexible plastic material. Advantageously, a sheet member manufactured from these materials would have a texture distinct from that of the sheet material out of which the envelope is constructed, making the envelope not only visually but also tactically stimulating. Moreover, sheet members made of these materials may be more durable than regular paper sheet material, and thus are more easily detached from the envelope.

By mounting the sheet member on the envelope with a few small strips of tape, the image-bearing sheet member may be promoted as a gift to the recipient. The sheet member can easily be detached from the envelope only after the recipient opens the envelope. The process of opening the envelope to retrieve the decorative slide will reveal the contents of the envelope to recipient, who may be more likely to read the materials rather than casually discard them.

No unnecessary limitations are to be understood from the foregoing detailed description, which is intended in all respects as illustrative of the preferred embodiment and not restrictive of the scope of the claims. Rather, the scope of the invention is to be defined by the appended claims. All changes or modifications of the present invention that come within the meaning of the claims or maintain substantial equivalence with such claims are intended to be embraced therein.

What is claimed is:

1. An envelope with decorative features for inducing a recipient to open the envelope, comprising:

an elongated strip of sheet material having an address panel and a display panel;

said display panel having at least one flap adapted to fold over and affix to said address panel to form an envelope enclosure;

one of said panels having a display window; and said window being adhesively affixed with a sheet member bearing an image, wherein said sheet member is translucent and is readily detachable from said envelope by removing adhesive strips affixing said sheet member to said window.

2. An envelope as set forth in claim 1 wherein the address panel further comprises an address window to display an address or other information imprinted on material inserted inside the envelope.

3. An envelope enclosure comprising:

an address panel and a display panel, said panels connected to form an enclosure wherein material may be inserted;

said enclosure being sealed to retain enclosed material within the enclosure; and one of said panels including a display window, said window having a decorative sheet member bearing an image adhesively affixed thereto, wherein said decorative sheet member bearing an image is transparent and is readily detachable from said envelope by removing adhesive strips affixing said decorative sheet member to said window.

4. An envelope enclosure comprising:

an address panel and a display panel, said panels connected to form an enclosure wherein material may be inserted;

said enclosure being sealed to retain enclosed material within the enclosure;

said address panel further comprising an address window to display an address or other information imprinted on material inserted inside the envelope; and said display panel including a display window, said window having a decorative sheet member bearing an image affixed thereto, wherein said decorative sheet member is transparent and readily detachable from said envelope by removing adhesive strips affixing said decorative sheet member to said window.

5. A mailing envelope having a window and decorative sheet member bearing an image mounted therein, comprising:

an address panel defining an addressable portion of the envelope;

a display panel having an interior surface and an exterior surface and defining a window display opening;

two side flaps providing means for attaching said address and display panels;

an envelope enclosure defined by an open side, said address panel, said display panel, and said two side flaps;

an envelope sealing flap extending upwardly from and contiguous to said display panel, adapted to fold over said address panel to seal off said open side of said envelope enclosure; and an image-bearing sheet member attached to said interior surface of said display panel;

said address panel and said side flaps being contiguous with said display panel along fold lines and adapted to fold along these fold lines to create said envelope enclosure.

6. A mailing envelope as set forth in claim 5 wherein said image-bearing sheet member is transparent.

7. A mailing envelope as set forth in claim 6 wherein said image-bearing sheet member is detachable from said interior surface of the display panel.

8. A mailing envelope as set forth in claim 5 wherein said image-bearing sheet member is opaque.

9. A method of attracting the interest and awareness of mailing recipients thereby inducing them to open the envelope and examine the contents therein, comprising the steps of:

providing a mailing envelope defining an enclosure, said envelope having a display window opening;

mounting an image-bearing sheet material over said display window opening within said enclosure of said envelope, wherein said image-bearing sheet material is transparent and readily detachable from said envelope by removing adhesive strips affixing said image-bearing sheet material over said window opening;

providing mailing materials to insert in said envelope;

inserting mailing materials in said enclosure; and delivering said mailing envelope for viewing by a recipient induced to open said envelope by said image-bearing sheet material.

10. The method of claim 9, further comprising the step of incorporating text on said envelope to promote said sheet material as a gift.

* * * * *

UNITED STATES PATENT AND TRADEMARK OFFICE

CERTIFICATE OF CORRECTION

PATENT NO. : 5,894,986

DATED : April 20, 1999

INVENTOR(S) : Fred B. Lederman et al.

It is certified that error appears in the above-identified patent and that said Letters Patent is hereby corrected as shown below:

Col. 1, line 37, delete "recipients" and insert therefor --recipient's--.

Col. 2, line 60, delete "60" and insert therefor --50--.

Col. 3, line 19, delete "68" and insert therefor --58--.

Col. 4, line 15, after "polyethylene" add --,--.

Signed and Sealed this

Twenty-ninth Day of February, 2000

*Attest:*

*Attesting Officer*

Q. TODD DICKINSON

*Commissioner of Patents and Trademarks*